US006575849B2

(12) United States Patent
Hayashi et al.

(10) Patent No.: US 6,575,849 B2
(45) **Date of Patent: *Jun. 10, 2003**

(54) GOLF BALL

(75) Inventors: Junji Hayashi, Chichibu (JP); Yutaka Masutani, Chichibu (JP); Hisashi Yamagishi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/929,491

(22) Filed: Aug. 15, 2001

(65) Prior Publication Data

US 2003/0022735 A1 Jan. 30, 2003

(30) Foreign Application Priority Data

Jun. 19, 2001 (JP) ..... 2001-185472

(51) Int. Cl.[7] ..... A63B 37/06
(52) U.S. Cl. ..... 473/377
(58) Field of Search ..... 473/377, 378, 473/376, 371, 351

(56) References Cited

U.S. PATENT DOCUMENTS 4,911,451 A * 3/1990 Sullivan et al. ..... 260/998.14
5,068,151 A * 11/1991 Nakamura ..... 428/407
5,298,571 A * 3/1994 Statz et al. ..... 260/998.14
5,490,673 A * 2/1996 Hiraoka ..... 473/372
5,752,889 A 5/1998 Yamagishi et al.
5,776,012 A * 7/1998 Moriyama et al. ..... 473/372
5,966,213 A 10/1999 Shimosaka et al.
6,386,993 B1 * 5/2002 Yokota ..... 473/373

FOREIGN PATENT DOCUMENTS

GB 2338421 A * 12/1999 ..... A63B/37/00
JP 6-277312 10/1994
JP 9-215778 8/1997
JP 11-30508 2/1999
JP 2000-5341 1/2000

* cited by examiner

*Primary Examiner*—Steven Wong
*Assistant Examiner*—Raeann Gorden
(74) *Attorney, Agent, or Firm*—Sughrue Mion, PLLC

(57) ABSTRACT

A golf ball includes a core and a cover made from a cover material mainly containing an ionomer resin and also an inorganic filler having a specific gravity of 3.50 or more in an amount of 10 to 25 parts by mass on the basis of 100 parts by mass of the ionomer resin. A flexural amount of the core, measured by applying a load of 980 N thereto, is in a range of 4.7 to 5.3 mm. A specific gravity of the cover material is in a range of 1.050 to 1.100, a thickness of the cover is in a range of 1.5 to 2.0 mm, and a Shore D hardness of the cover is in a range of 57 to 63. A weight of the golf ball is in a range of 45.0 to 46.0 g, and a flexural amount of the golf ball, measured by applying a load of 980 N thereto, is in a range of 3.7 to 4.3 mm. A weight (W) of the golf ball and an inertia moment (MI) thereof satisfy a relationship of $1.53 \times W + 13.32 \leqq MI \leqq 1.61 \times W + 11.02$. Such a golf ball can enhance the resilience to increase the carry of the ball, realize player's feeling of hitting the ball, and improve the durability against cracking.

15 Claims, 2 Drawing Sheets

GOLF BALL

BACKGROUND OF THE INVENTION

The present invention relates to a golf ball capable of enhancing the resilience to increase the carry of the ball, realizing player's soft feeling of hitting the ball, and improving the durability against cracking.

A method of improving a cover material by adding an inorganic filler (titanium dioxide and barium sulfate) thereto has been proposed, for example, in Japanese Patent Laid-open No. Hei 6-277312. The addition of titanium dioxide and barium sulfate to the cover of a golf ball is effective to give excellent properties such as a carrying performance to the golf ball. With respect to the reason for this, the document describes that the addition of titanium dioxide and barium sulfate to the cover "shifts a weight distribution in the ball from the core center to the cover side, to increase an inertia moment of the ball, thereby increasing the carry of the golf ball".

Such a proposal, however, has been required to be further improved in terms of factors determining golf ball performances, for example, a hardness factor of the cover and core, a composition factor of the cover and core, and a dimple factor. In particular, the ball disclosed in the embodiment of the above proposal has been required to be improved in terms of feeling of hitting the ball and the carry of the ball.

On the other hand, Japanese Patent Laid-open No. Hei 9-215778 has proposed a two-piece solid golf ball improved in its carry, controllability, and linearity by using a cover material having a relatively large specific gravity and optimizing the cover hardness, inertia moment, and dimple pattern.

The solid golf ball of the above document, however, has the following problem: namely, in the case of using a thermoplastic urethane elastomer or the like as the cover material, if the cover hardness is set in a softer range (near Shore hardness 50), the golf ball exhibits high performances; however, if the cover hardness is set in a harder range (near Shore hardness 60), it may often fail to simultaneously improve the resilience, durability against cracking, and player's soft feeling of hitting the ball.

The golf ball of the above document has been also required to be optimized in terms of the inertia moment.

On the other hand, the properties of a golf ball strongly demanded by golf players are generally player's soft feeling at the time of hitting the ball and the carrying performance of the ball; however, it is regarded as difficult to make both the properties compatible with each other for the following reasons:

(1) If the core is softened for ensuring the player's soft feeling, a deformed amount of the hit ball becomes large, to degrade the durability against cracking.

(2) If both the core and cover are softened for ensuring both the player's soft feeling and durability against cracking, the resilience and initial velocity of the ball are reduced, to sacrifice the carrying performance.

(3) If the ball is excessively improved only in terms of the player's soft feeling, the other properties are sacrificed, to cause such an inconvenience that local deformation of the hit ball becomes large, not to keep the sphericalness of the ball at the initial stage of the carry of the ball, thereby degrading the carrying performance.

To solve the above problems, Japanese Patent Laid-open No. 2000-5341 has proposed an excellent golf ball characterized by combining a core, which is softened to improve the player's soft feeling and durability against cracking, with a cover to which a reinforcement filler is added.

Such a golf ball, however, has been required to be further improved in terms of resilience, carry, player's soft feeling of hitting the ball, and durability against cracking.

SUMMARY OF THE INVENTION

An object of the present invention is to provide a golf ball capable of enhancing the resilience to increase the carry of the ball, realizing player's soft feeling of hitting the ball, and improving the durability against cracking.

As a result of an examination made by the present inventor in order to achieve the above object, it has been found that a golf ball including: a core and a cover made from a cover material mainly containing an ionomer resin and also an inorganic filler having a specific gravity of 3.50 or more in an amount of 10 to 25 parts by mass on the basis of 100 parts by mass of the ionomer resin; wherein a flexural amount of the core, measured by applying a load of 980 N thereto, is in a range of 4.7 to 5.3 mm; a specific gravity of the cover material is in a range of 1.050 to 1.100, a thickness of the cover is in a range of 1.5 to 2.0 mm, and a Shore D hardness of the cover is in a range of 57 to 63; a weight of the golf ball is in a range of 45.0 to 46.0 g, and a flexural amount of the golf ball, measured by applying a load of 980 N thereto, is in a range of 3.7 to 4.3 mm; and a weight (W) of the golf ball and an inertia moment (MI) thereof satisfy a relationship of $1.53\times W+13.32 \leqq MI \leqq 1.61\times W+11.02$, is advantageous in enhancing the resilience to increase the carry of the ball, realizing player's soft feeling of hitting the ball, and improving the durability against cracking by a synergism effect of the above-described optimized requirements. The reasons for this are as follows:

(1) Since each of the core and ball is very softened by optimizing the flexural amount thereof, it is possible to lower the spin of the ball and hence to improve the carry of the ball, and also to realize player's soft feeling.

(2) Since the hardness of the cover is set to a suitable value (near Shore D hardness 60), it is possible to keep high resilience while keeping good player's feeling of hitting the ball.

(3) Since an inorganic filler having a particular specific gravity is added to the cover, it is possible to suppress degradation of the durability against cracking due to realization of player's soft feeling of hitting the ball, and since the mixing ratio of the inorganic filler is optimized, it is possible to suppress a reduction in initial velocity of the hit ball due to excessive addition of the inorganic filler to the cover resin.

(4) Since an inertia moment suitable to a low spin structure (relatively harder cover+soft core) is realized, it is possible to increase the carry of the ball.

(5) Since the core is made from a rubber composition including an organic sulfur compound as needed and also the kind of the ionomer resin is specified as needed, it is possible to further improve the resilience, and since the dimples are optimized, it is possible to further improve the carrying performance.

Accordingly, the present invention provides a golf ball including: a core and a cover made from a cover material mainly containing an ionomer resin and also an inorganic filler having a specific gravity of 3.50 or more in an amount of 10 to 25 parts by mass on the basis of 100 parts by mass of the ionomer resin; wherein a flexural amount of the core, measured by applying a load of 980 N thereto, is in a range of 4.7 to 5.3 mm; a specific gravity of the cover material is in a range of 1.050 to 1.100, a thickness of the cover is in a range of 1.5 to 2.0 mm, and a Shore D hardness of the cover is in a range of 57 to 63; a weight of the golf ball is in a range of 45.0 to 46.0 g, and a flexural amount of the golf ball, measured by applying a load of 980 N thereto, is in a range of 3.7 to 4.3 mm; and a weight (W) of the golf ball and an inertia moment (MI) thereof satisfy a relationship of $1.53\times W+13.32 \leqq MI \leqq 1.61\times W+11.02$.

In the above golf ball, the inorganic filler preferably contains barium sulfate and titanium dioxide.

The ionomer resin is preferably composed of an Li ion neutralized ionomer resin and a Mg ion neutralized ionomer resin.

The core is preferably made from a rubber composition containing polybutadiene as a main rubber component and also an organic sulfur compound.

A diameter of the golf ball is preferably in a range of 42.65 to 42.75 mm

The golf ball preferably has in the cover surface a large number of dimples; and a dimple total volume ratio (VR) is preferably in a range of 0.85% or less, the dimple total volume ratio being defined as a ratio of a total volume of dimple spaces each of which is present under a plane surface surrounded by an edge portion of the dimple to a total volume of a virtual ball being the same as the golf ball except that the virtual ball has no dimples.

The Shore D hardness of the cover is preferably set to 60.

The thickness of the cover is preferably set to 1.9 mm.

The specific gravity of the cover is preferably set to 1.090.

A flexural amount of the core, measured by applying a load of 980 N thereto, is preferably set to 5.0 mm.

The flexural amount of the golf ball, measured by applying a load of 980 N thereto, is preferably set to 4.0 mm.

DETAILED DESCRIPTION OF THE PREFERRED EMBODIMENTS

Figure 1:
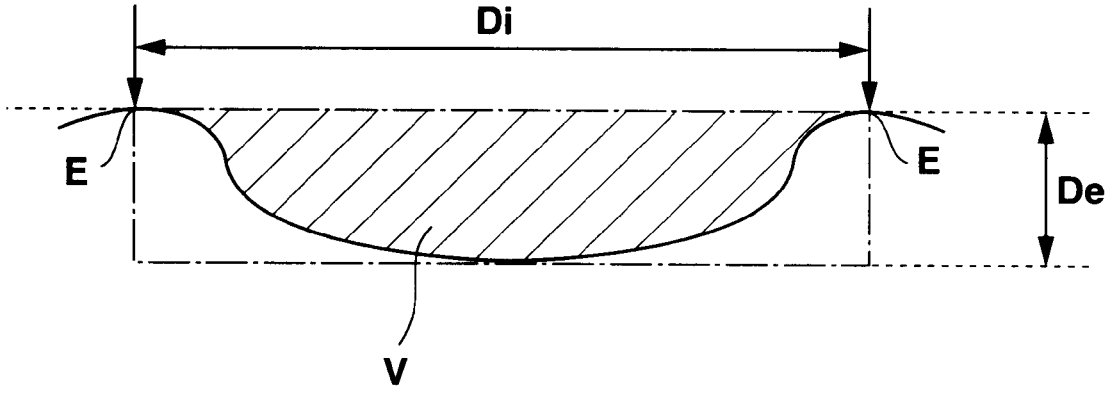
FIG. 1 is a sectional view of one dimple of a golf ball illustrating the definition of a dimple total volume ratio (VR).
Figure 2:
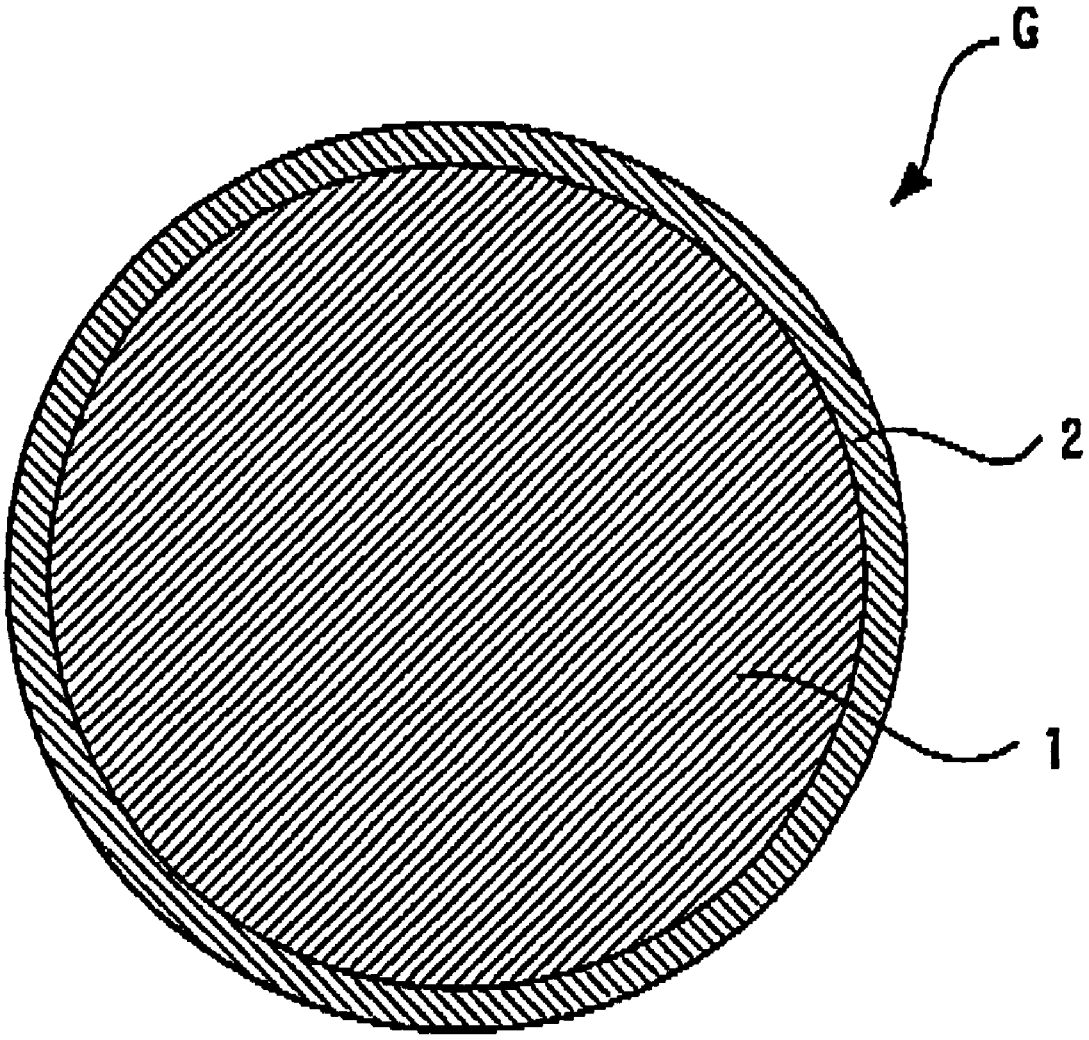
FIG. 2 is a sectional view of a golf ball of the present invention having a core and a cover.

The present invention will be hereinafter described in more detail. A golf ball of the present invention includes a solid core and a cover. The solid core can be made from a known core material.

The solid core of the present invention is preferably made from a rubber composition containing polybutadiene as a main rubber component, more preferably, a rubber composition containing polybutadiene as a main rubber component and also an organic sulfur compound.

Concretely, cis-1,4-polybutadiene may be used as polybutadiene as the main rubber component of the rubber composition.

In addition to polybutadiene, another diene based rubber, such as styrene-butadiene rubber (SBR), natural rubber, isoprene rubber, or ethylene-propylene-diene rubber (EPDM) may be suitably mixed in the above base rubber.

The solid core of the present invention contains an organic sulfur compound for significantly improving the resilience thereof.

Examples of the organic sulfur compounds may include thiophenol, thionaphthol, halogenated thiophenol, or metal salts thereof, more concretely, zinc salts of pentachlorothiophenol, pentafluorothiophenol, pentabromothiophenol, and parachlorothiophenol; and diphenyl polysulfide, dibenzil polysulfide, dibenzoil polysulfide, dibenzothiazoil polysulfide, and dithiobenzoil polysulfide, each of which has the sulfur number of 2 to 4. In particular, a zinc salt of pentachlorothiophenol or diphenyl disulfide is preferably used.

According to the present invention, the content of the organic sulfur compound may be set, on the basis of 100 parts by mass of the main rubber component, in a range of 0.05 part by mass or more, preferably, 0.10 part by mass or more, more preferably, 0.20 part by mass or more, with the upper limit being in a range of 3.00 parts by mass or less, preferably, 2.50 parts by mass or less, more preferably, 2.00 parts by mass or less. If the content is excessively small, the resilience is not improved, and if excessively large, the hardness and strength of the core are reduced, and further it may take a lot of time to mold the rubber composition.

In addition to the above-described components, unsaturated carboxylic acid and/or a metal salt thereof and an organic peroxide can be incorporated into the rubber composition of the solid core of the present invention.

Examples of the unsaturated carboxylic acids may include acrylic acid, metacrylic acid, maleic acid, fumaric acid. In particular, acrylic acid and metacrylic acid are preferably used.

Examples of the metal salts of unsaturated carboxylic acids may include zinc salts and magnesium salts of unsaturated aliphatic acids, for example, zinc metacrylate and zinc acrylate. In particular, zinc acrylate is preferably used.

The content of the unsaturated carboxylic acid and/or metal salt thereof may be set, on the basis of 100 parts by mass of the main rubber component, in a range of 10 parts by mass or more, preferably, 15 parts by mass or more, more preferably, 20 parts by mass or more, with the upper limit being in a range of 50 parts by mass or less, preferably, 45 parts by mass or less, more preferably, 40 parts by mass or less, most preferably, 35 parts by mass or less. If the content is excessively small, the resilience is reduced, and if excessively large, the solid core becomes excessively harder, which may sometimes make player's feeling of hitting of the golf ball undesirable.

As the organic peroxide, there can be used a commercial product such as "Percumyl D" (sold by NOF CORPORATION), "Perhexa 3M" (sold by NOF CORPORATION), "Luperco 231XL" (sold by Elf Atochem Japan). Two kinds or more organic peroxides may be used in combination as needed.

The content of the organic peroxide may be set, on the basis of 100 parts by mass of the main rubber component, in a range of 0.1 part by mass or more, preferably, 0.3 part by mass or more, more preferably, 0.5 part by mass or more, with the upper limit being in a range of 5 parts by mass or less, preferably, 4 parts by mass or less, more preferably, 3 parts by mass or less, most preferably, 2 parts by mass or less. If the content is excessively large or small, the resilience, player's feeling of hitting the golf ball, and durability against cracking may be reduced.

An inorganic filler can be added to the rubber composition of the present invention for adjusting the specific gravity, as needed. Examples of the inorganic fillers may include zinc oxide, barium sulfate, and calcium carbonate. In order to obtain a suitable weight and desirable resilience, the content of the inorganic filler may be set, on the basis of 100 parts by mass of the main rubber component, in a range of 1 part by mass or more, preferably, 3 parts by mass or more, more preferably, 5 parts by mass or more, most preferably, 7 parts by mass or more, with the upper limit being in a range of 60 parts by mass or less, preferably, 50 parts by mass or less, more preferably, 45 parts by mass or less, most preferably, 40 parts by mass or less.

An antioxidant may be further added to the rubber composition of the present invention, as needed. As the antioxidant, there can be used a commercial product such as "NOCRAC NS-6, NS-30" (sold by Ouchi-Sinko Chemical Industrial Co., Ltd.), or "Yoshinox 425" (Yoshitomi Pharmaceutical Co., Ltd.). In order to obtain desirable resilience and durability, the content of the antioxidant may be set, on the basis of 100 parts by mass of the main rubber component, in a range of 0 part by mass or more, preferably, 0.05 part by mass or more, more preferably, 0.1 part by mass or more, most preferably, 0.2 part by mass or more, with the upper limit being in a range of 3 parts by mass or less, preferably, 2 parts by mass or less, more preferably, 1 part by mass or less, most preferably, 0.5 part by mass or less.

The solid core of the present invention can be formed by vulcanizing and heating the above-described rubber composition by a known process. For example, a vulcanizing temperature may be set in a range of 100 to 200° C., and a vulcanizing time be set in a range of 10 to 40 min.

The hardness of the solid core of the present invention, which is expressed in a deformed amount of the solid core measured by applying a load of 980 N (100 kg) thereto, may be set in a range of 4.7 mm or more, preferably, 4.8 mm or more, with the upper limit being in a range of 5.3 mm or less, preferably, 5.2 mm or less. Most preferably, the hardness of the solid core is set to 5.0 mm. If the flexural amount, that is, the deformed amount is excessively small, player's feeling of hitting the golf ball is degraded, and particularly, the spin of the ball becomes excessively high at the time of long-shot with a driver when the ball is liable to be largely deformed, to reduce the carry of the ball, and if excessively large, player's feeling of hitting the ball becomes dull, the carry of the ball is reduced because of insufficient resilience, and the durability against cracking due to repeated hitting is degraded.

The diameter of the solid core of the present invention may be set in a range of 38.5 mm or more, preferably, 38.6 mm or more, more preferably, 38.7 mm or more, most preferably, 38.8 mm or more, with the upper limit being in a range of 39.9 mm or less, preferably, 39.8 mm or less, more preferably, 39.7 mm or less, most preferably, 39.6 mm or less.

The specific gravity of the solid core may be set in a range of 1.000 or more, preferably, 1.050 or more, more preferably, 1.100 or more, with the upper limit being in a range of 1.300 or less, preferably, 1.250 or less, more preferably, 1.200 or less.

The golf ball of the present invention is a solid golf ball including the above-described solid core and a cover. Such a solid golf ball may be any one of a two-piece type including one cover layer and a multi-piece type including two or more cover layers. According to the present invention, however, from the viewpoint of effectively achieving the effect of improving a golf ball, the golf ball may be of a two-piece solid golf ball.

The cover of the golf ball of the present invention is required to be made from a cover material mainly containing an ionomer resin. As the above ionomer resin, there can be used a commercial product, for example, "Surlyn 6320, 8120, or 7930" (Du Pont DE NEMOURS & COMPANY, USA) or "Himilan 1706, 1605, 1855, 1601, or 1557" (Du Pont-Mitsui Polychemicals Co., Ltd.).

According to the present invention, to improve the resilience, the ionomer resin may be composed of an Li ion neutralized ionomer resin and a Mg ion neutralized ionomer resin. In this case, the mixing ratio in mass between the Li ion neutralized ionomer resin and the Mg ion neutralized ionomer resin may be set in a range of 95:5 to 10:90, preferably, 90:10 to 30:70. If the mixing ratio is out of the above range, it may fail to improve the resilience.

The cover material of the present invention is required to contain an inorganic filler having a specific gravity of 3.50 or more. As the inorganic filler, there can be used a metal based filler. Example of the metal based fillers may include barium sulfate, titanium dioxide, and tungsten. In particular, barium sulfate and titanium dioxide may be used in combination. By the use of these components in combination, it is possible to improve the durability and also to give a desirable appearance not tinged with yellow to the ball.

According to the present invention, the content of the inorganic filler (in particular, the total content of the barium sulfate and titanium dioxide) may be set, on the basis of 100 parts by mass of the ionomer resin, in a range of 10 parts by mass or more, preferably, 11 parts by mass or more, more preferably, 12 parts by mass or more, with the upper limit being in a range of 25 parts by mass or less, preferably, 24 parts by mass or less, more preferably, 23 parts by mass or less. If the content is excessively small, it fails to improve the durability against cracking, and if excessively large, the resilience and the moldability may be reduced.

According to the present invention, the specific gravity of the inorganic filler may be set in a range of 3.50 or more, preferably, 3.60 or more, more preferably, 3.70 or more, with the upper limit being in a range of 20 or less, preferably, 10 or less, more preferably, 7.5 or less. If the specific gravity of the inorganic filler is out of the above range, the durability against cracking may be not improved, and the resilience be reduced.

The specific gravity of the cover material of the present invention may be set in a range of 1.050 or more, preferably, 1.060 or more, more preferably, 1.070 or more, with the upper limit being in a range of 1.100 or less. Most preferably, the specific gravity of the cover material is set to 1.090. If the specific gravity is excessively large, a large amount of the filler must be added, tending to reduce the resilience, and if excessively small, the effect of mixing the filler cannot be achieved, tending to degrade the durability against cracking.

In addition, a UV absorbent, an oxidation inhibitor, a dispersant, and a coloring agent may be added to the cover material, as needed.

The cover of the golf ball of the present invention can be formed by a known process of putting the solid core in a specific mold for injection molding, and injection-molding the cover material. Alternatively, the cover can be formed by preparing a pair of cup-halves made from the cover material, putting the solid core covered with the cup-halves in a specific mold, and press-molding the resultant solid core covered with the cup-halves.

The Shore D hardness of the cover of the golf ball of the present invention may be set in a range of 57 or more, preferably, 58 or more, more preferably, 59 or more, with the upper limit being in a range of 63 or less, preferably, 62 or less, more preferably, 61 or less. Most preferably, the Shore D hardness of the cover is set to 60. If the hardness is higher than the above range, player's feeling of hitting the ball is degraded, and if lower than the above range, the resilience is reduced.

In spite of the type of the golf ball, that is, a two-piece solid golf ball or a multi-piece solid golf ball (in this case, the thickness of a cover is the total thickness of cover layers), the thickness of the cover may be set in a range of 1.5 mm or more, preferably, 1.6 mm or more, with the upper limit being in a range of 2.0 mm or less. Most preferably, the thickness of the cover is set to 1.9 mm. If the cover is excessively thick, player's feeling of hitting the ball is degraded, and if excessively thin, the durability against cracking is degraded.

The hardness of the golf ball of the present invention, which is expressed in a deformed amount of the solid core measured by applying a load of 980 N (100 kg) thereto, may be set in a range of 3.7 mm or more, preferably, 3.8 mm or more, with the upper limit being in a range of 4.3 mm or less, preferably, 4.2 mm or less. Most preferably, the hardness of the golf ball is set to 4.0 mm. If the flexural amount, that is, the deformed amount is excessively small, player's feeling of hitting the golf ball is degraded, and particularly, the spin of the ball becomes excessively high at the time of long-shot with a driver when the ball is liable to be largely deformed, to reduce the carry of the ball, and if excessively large, player's feeling of hitting the ball becomes dull, the carry of the ball is reduced because of insufficient resilience, and the durability against cracking due to repeated hitting is degraded.

The weight of the golf ball of the present invention may be set in a range of 45.0 g or more, preferably, 45.1 g or more, with the upper limit being in a range of 46.0 g or less, preferably, 45.9 g or less. If the weight is excessively large, the carry of the ball may be often reduced because the golf ball is less flied up, and if excessively small, the carry of the ball may be often reduced because the inertia of the ball is lowered.

The diameter of the golf ball of the present invention may be set in a range of 42.65 mm or more, preferably, 42.67 mm or more, with the upper limit being in a range of 42.75 mm or less, preferably, 42. 73 mm or less.

The inertia moment of the golf ball of the present invention is required to be optimized. According to the present invention, the inertia moment of the golf ball is calculated from the diameter and the specific gravity of a spherical ball (golf ball) composed of the core covered with the cover. In addition, the structure of the spherical ball differs depending on the stacked structure of the golf ball, for example, a stacked structure of (core+intermediate layer) in which the core is covered with an intermediate layer or a stacked structure of (core+inner cover) in which the core is covered with an inner cover. Further, the specific gravity of the spherical body is calculated from the weight of each layer constituting part of the spherical body and the outer diameter of a true ball which is the same as the golf ball except that the true ball has no dimples.

The inertia moment (MI) of the golf ball is calculated on the basis of the following formula:

Two-Piece Ball:

$$MI=A\times\{(\text{specific gravity of core}-\text{virtual specific gravity of cover})\times(\text{outer diameter of core})^5+(\text{virtual specific gravity of cover})\times(\text{outer diameter of ball})^5\}$$

Three-Piece Ball:

$$MI=A\times\{((\text{specific gravity of core}-\text{specific gravity of intermediate layer})\times(\text{outer diameter of core})^5+(\text{specific gravity of intermediate layer}-\text{virtual specific gravity of cover})\times(\text{outer diameter of intermediate layer})^5+(\text{virtual specific gravity of cover})\times(\text{outer diameter of ball})^5\}$$

MI: inertia moment (unit: $g\times cm^2$)

A: constant=$\pi/5880000$

Unit of outer diameter of each layer: (mm)

Virtual specific gravity of the cover: calculated by using a virtual spherical cover which is the same as the actual cover except that the virtual cover has no dimples (note: the specific gravity of the cover used for calculating the inertia moment according to the present invention is smaller than the specific gravity of a resin forming the actual cover).

In addition, if the three-piece ball includes not the intermediate layer but an inner cover, the calculation is made by substituting the intermediate layer for the inner cover.

According to the golf ball of the present invention, letting the weight of the golf ball be (W) and the above inertia moment be (MI), the inertia moment (MI) is required to be in a range of (1.53×W+13.32) or more, preferably, (1.53×W+13.42) or more, with the upper limit being in a range of (1.61×W+11.02) or less, preferably, (1.61×W+10.92) or less. If the inertia moment is excessively small or large, it fails to enhance the carry of the ball.

Like a general golf ball, the golf ball of the present invention has in the cover surface a large number of dimples. These dimples may be optimized for enhancing the carry of the ball by preventing the drop of the ball.

The optimization of the dimples will be described with reference to FIG. 1. FIG. 1 is an enlarged sectional view of one dimple illustrating the definition of a VR (Volume Ratio) of dimples according to the present invention. In the figure, the right and left top points E at the edge portion of the dimple are horizontally positioned, and the deepest portion of the dimple having a maximum depth De is located at the center of the dimple.

To be more specific, the top points E are defined as points at which a dimple diameter Di crosses a circle formed by the edge portion of the dimple, and the maximum depth De is defined as a distance from a line connecting the points E to each other to the deepest portion of the dimple. Each dimple volume V is defined as a volume of the dimple space present under the plane surface surrounded by the edge portion of the dimple.

According to the present invention, the dimples are optimized by specifying a dimple total volume ratio (VR) in a range of 0.85% or less, preferably, 0.84% or less, more preferably, 0.83% or less. The dimple total volume ratio (VR) is defined as a ratio of a total volume of dimple spaces each of which is present under a plane surface surrounded by an edge portion of the dimple to a total volume of a virtual ball being the same as the golf ball except that the virtual ball has no dimples. With this optimization of the dimples, it is possible to prevent the drop of the hit ball, and hence to improve the carry of the ball.

The volume V of each dimple can be measured, for example, by a measurement apparatus described in Japanese Patent Laid-open No. Hei 11-30508. If the dimples are not optimized as described above, the hit ball may be dropped, whereby it may often fail to obtain a long carry of the ball. In addition, there is no limitation to the total number, kinds, shape, and the like of the dimples. For example, the total number of the dimples may be set in a range of 350 pieces or more, preferably, 370 pieces or more, with the upper limit being in a range of 500 pieces or less, preferably, 480 pieces or less. The kinds of the dimples may be set in a range of two or more, preferably, three or more. The shape of each dimple is not limited to the circular shape, and the diameter of each dimple may be set in a range of 2.0 mm or more, preferably, 2.2 mm or more, with the upper limit being in a range of 5.0 mm or less, preferably, 4.8 mm or less.

As described above, the present invention provides a golf ball capable of enhancing the resilience to increase the carry of the ball, realizing player's soft feeling of hitting the ball, and improving the durability against cracking.

EXAMPLES

The present invention will be more clearly understood by way of, while not limited thereto, the following example and comparative examples.

Example 1 and Comparative Examples 1 to 3

A rubber composition for a solid core was prepared by mixing respective core components with 100 parts by mass of polybutadiene (BR11, BR18, sold by Japan Synthetic Rubber Co., Ltd.) as shown in Table 1, and a solid core was produced from the rubber composition. In Table 1, "Percumyl D" (sold by NOF CORPORATION) was used as dicumyl peroxide, and NOCRAK NS-6 (sold by Ouchi-Sinko Chemical Industrial Co., Ltd.) was used as an antioxidant.

A cover material having a composition shown in Table 1 was prepared, and physical properties thereof were examined. Commercial products used for the cover material and methods of measuring the physical properties of the cover material are as follows:

Surlyn

This is an ionomer resin sold by Du Pont DE NEMOURS & COMPANY, USA. A metal name in each parenthesis designates a metal ion type used for neutralization.

Himilan

This is an ionomer resin sold by Du Pont-Mitsui Polychemicals Co., Ltd. A metal name in each parenthesis designates a metal ion type used for neutralization.

Pandex

This is a thermoplastic polyurethane based elastomer sold by Dainippon Ink & Chemicals, Incorporated.

Shore D Hardness

The hardness not on the surface of the ball but on the surface of the resin sheet was measured under JIS-K 6253 by using a duro-meter of Type D under ASTM D2240.

Specific Gravity

The specific gravity of the sheet-shaped cover material was measured by using a specific gravity meter.

Thickness of Cover

The thickness of the cover was calculated on the basis of an equation of (outer diameter of ball−outer diameter of core)/2.

Outer Diameter of Ball

The outer diameter of the ball at a portion with no dimple was measured.

Inertia Moment (MI)

The inertia moment was calculated as follows:

$$MI = A \times \{((\text{specific gravity of core} - \text{virtual specific gravity of cover}) \times (\text{outer diameter of core})^5 + (\text{virtual specific gravity of cover}) \times (\text{outer diameter of ball})^5\}$$

MI: inertia moment (unit: g×cm$^2$)

A: constant=π/5880000

Unit of outer diameter of each layer: (mm)

Virtual specific gravity of the cover: calculated by using a virtual spherical cover which is the same as the actual cover except that the virtual cover has no dimples (note: the specific gravity of the cover used for calculating the inertia moment according to the present invention is smaller than the specific gravity of a resin forming the actual cover).

Dimple VR

The dimple total volume ratio (VR) was determined by measuring each dimple volume in accordance with an apparatus and a method disclosed in Japanese Patent Laid-open No. Hei 11-30508.

Durability of Ball

Each ball was hit against a steel plate at a speed of 55 m/s, and the number of cracking was measured. The durability of the ball was expressed in an index which was the number of cracking on the basis (100) of the number of cracking of a commercial two-piece solid golf ball (PRECEPT MC LADY, sold by Bridgestone Sports Co. Ltd.).

Flexural Amount Measured by Applying Load of 980 N

The deformed amount (mm) of each of the solid core and ball at the time of applying a load of 980 N (100 kg) thereto was measured.

Player's Feeling of Hitting

Most common one of functional evaluations made by five superior amateur players at the time of hitting golf balls with a driver.

Physical Properties of Golf Ball

The ball was hit with a swing robot (Miyamae Co. Ltd.), to which a driver (PRO230Titan, sold by Bridgestone Sports Co., Ltd.) was mounted, at a head speed of 50 m/s, and the carry (total) of the ball was measured. The initial velocity and spin of the ball immediately after hitting were measured by using a high-speed camera.

TABLE 1

| | | Example | Comparative Example | | |
|---|---|---|---|---|---|
| | | 1 | 1 | 2 | 3 |
| Core | Composition (Parts by mass) | | | | |
| | Polybutadiene BR 11 | 70 | 70 | 70 | 70 |
| | Polybutadiene BR 18 | 30 | 30 | 30 | 30 |
| | Zinc acrylate | 26.0 | 25.8 | 22.7 | 28.7 |
| | Zinc oxide | 5.0 | 5.0 | 5.0 | 5.0 |
| | Barium sulfate | 11.6 | 18.0 | 10.2 | 4.3 |
| | Zinc salt of pentachlorothiophenol | 1.0 | 1.0 | 0.0 | 0.0 |
| | Antioxidant | 0.1 | 0.1 | 0.1 | 0.1 |
| | Dicumyl peroxide | 1.4 | 1.4 | 1.4 | 1.4 |
| | Outer diameter (mm) | 38.9 | 39.0 | 39.1 | 38.9 |
| | Weight (g) | 34.9 | 36.3 | 34.8 | 33.7 |
| | Hardness (mm) | 4.9 | 4.8 | 4.9 | 3.2 |
| Cover | Composition (Parts by mass) | | | | |
| | Surlyn 7930 (Li) | 66 | | | |
| | Surlyn 6320 (Mg) | 34 | | | |
| | Himilan 1557 (Zn) | | 52 | | |
| | Himilan 1601 (Na) | | 48 | | |
| | Himilan 1605 (Na) | | | 82 | |
| | Surlyn 9320 (Zn) | | | 18 | |
| | Pandex T-1198 | | | | 100 |
| | Barium sulfate | 15 | | 22 | |
| | Titanium dioxide | 5 | 5 | 5 | 5.3 |
| | Magnesium stearate | 1 | 1 | 1 | 0.5 |
| | Pigment | 0.05 | 0.05 | 0.05 | 0.05 |
| | Shore D hardness | 60 | 59 | 60 | 53 |
| | Specific gravity | 1.090 | 0.980 | 1.140 | 1.210 |
| | Thickness (mm) | 1.9 | 1.8 | 1.8 | 1.9 |
| Dimple | Number (piece) | 432 | 432 | 392 | 432 |
| | VR (%) | 0.77 | 0.77 | 0.78 | 0.77 |
| Ball | Outer diameter (mm) | 42.7 | 42.7 | 42.7 | 42.7 |

TABLE 1-continued

| | Example | Comparative Example | | |
|---|---|---|---|---|
| | 1 | 1 | 2 | 3 |
| Weight (g) | 45.2 | 45.2 | 45.1 | 45.2 |
| Calculated inertia moment ($gcm^2$) | 83.2 | 81.7 | 83.7 | 84.8 |
| 1.53 × W = 13.32 | 82.5 | 82.4 | 82.4 | 82.5 |
| 1.61 × W = 11.02 | 83.8 | 83.7 | 83.7 | 83.8 |
| Hardness (mm) | 4.0 | 3.9 | 4.0 | 2.9 |
| Durability | 110 | 55 | 125 | 150 or more |
| Initial speed (m/s) | 72.0 | 72.0 | 71.2 | 71.4 |
| Spin (rpm) | 2620 | 2650 | 2630 | 3000 |
| Carry (m) | 262.0 | 260.0 | 256.5 | 257.0 |
| Player's feeling of hitting | Soft and good | Soft and good | Soft and good | Hard |

As is apparent from the results shown in Table 1, each of the golf balls in Example 1 can enhance the resilience to increase the carry of the ball, realize player's soft feeling of hitting the ball, and improve the durability against cracking.

On the contrary, each of the golf balls in Comparative Examples 1 to 3 exhibits the following disadvantages:

Comparative Example 1

The two-piece solid golf ball using a usual ionomer resin made cover in this example is good in resilience and player's feeling of hitting the ball; however, since the inertia moment is not optimized (excessively small), the carry of the ball becomes short.

Since the cover is made from the usual ionomer resin, the durability against cracking is very degraded and thereby the golf ball cannot be used for a long period of time.

Comparative Example 2

The ball using a cover material containing barium sulfate in this example is good in durability; however, since the added amount of the inorganic filler is excessively large, the resilience is degraded and the carry of the ball becomes very short.

Comparative Example 3

The two-piece solid golf ball having a thermoplastic urethane cover in this example is good in durability but poor in resilience because the cover is soft and the ball is harder. Since the ball is harder than each of the balls in the other examples and the cover is softer, the spin of the ball becomes excessively high. Further, the specific gravity of the cover is very large and the inertia moment is not optimized (excessively large). As a result of the degraded resilience, spin, and inertia moment, the carry of the ball becomes short. In addition, player's feeling of the ball with a driver is hard.

While the preferred embodiments of the present invention have been described using specific terms, such description is for illustrative purpose only, and it is to be understood that changes and variations may be made without departing from the spirit or scope of the following claims.

What is claimed is:

1. A golf ball comprising:

a core; and a cover made from a cover material mainly containing an ionomer resin and also an inorganic filler having a specific gravity of 3.50 or more in an amount of 10 to 25 parts by mass on the basis of 100 parts by mass of said ionomer resin;

wherein a flexural amount of said core, measured by applying a load of 980 N thereto, is in a range of 4.7 to 5.3 mm;

a specific gravity of said cover material is in a range of 1.050 to 1.100, a thickness of said cover is in a range of 1.5 to 2.0 mm, and a Shore D hardness of said cover is in a range of 57 to 63;

a weight of said golf ball is in a range of 45.0 to 46.0 g, and a flexural amount of said golf ball, measured by applying a load of 980 N thereto, is in a range of 3.7 to 4.3 mm; and a weight (W) of said golf ball and an inertia moment (MI) thereof satisfy a relationship of $1.53 \times W + 13.32 \leqq MI \leqq 1.61 \times W + 11.02$.

2. A golf ball according to claim 1, wherein said inorganic filler contains barium sulfate and titanium dioxide.

3. A golf ball according to claim 1, wherein said ionomer resin is composed of an Li ion neutralized ionomer resin and a Mg ion neutralized ionomer resin.

4. A golf ball according to claim 1, wherein said core is made from a rubber composition containing polybutadiene as a main rubber component and also an organic sulfur compound.

5. A golf ball according to claim 1, wherein a diameter of said golf ball is in a range of 42.65 to 42.75 mm.

6. A golf ball according to claim 1, wherein said golf ball has, in the cover surface, a large number of dimples; and a dimple total volume ratio (VR) of 0.85% or less, wherein said dimple total volume ratio (VR) is defined as a ratio of a total volume of dimple spaces, each of which is present under a plane surface surrounded by an edge portion of said dimple, to a total volume of a virtual ball being the same as said golf ball except that said virtual ball has no dimples.

7. A golf ball according to claim 1, wherein the Shore D hardness of said cover is set to 60.

8. A golf ball according to claim 1, wherein the thickness of said cover is set to 1.9 mm.

9. A golf ball according to claim 1, wherein the specific gravity of said cover is set to 1.090.

10. A golf ball according to claim 1, wherein a flexural amount of said core, measured by applying a load of 980 N thereto, is set to 5.0 mm.

11. A golf ball according to claim 1, wherein the flexural amount of said golf ball, measured by applying a load of 980 N thereto, is set to 4.0 mm.

12. A golf ball according to claim 1, wherein a Shore D hardness of said cover is in a range of 57 to 60.

13. A golf ball according to claim 1, wherein the diameter of the solid core is 38.5 mm or more.

14. A golf ball according to claim 3, wherein the mixing ratio in mass between the Li ion neutralized ionomer resin and the Mg ion neutralized ionomer resin is set in a range of 95:5 to 10:90.

15. A golf ball according to claim 3, wherein the mixing ratio in mass between the Li ion neutrelized ionomer resin and the Mg ion neutralized ionomer resin is set in a range of 90:10 to 30:70.

* * * * *